United States Patent [19]

Szema

[11] 4,192,138

[45] Mar. 11, 1980

[54] GAS TURBINE COMBUSTOR AIR INLET

[75] Inventor: Li-Chieh Szema, Nether Providence, Pa.

[73] Assignee: Westinghouse Electric Corp., Pittsburgh, Pa.

[21] Appl. No.: 828,465

[22] Filed: Aug. 29, 1977

[51] Int. Cl.[2] ..... F02C 7/00

[52] U.S. Cl. ..... 60/759; 431/351

[58] Field of Search ..... 60/39.65, 39.69; 98/35, 98/37, 61, 62, 64; 431/351, 352, 353

[56] References Cited

U.S. PATENT DOCUMENTS

| | | | |
|---|---|---|---|
| 2,601,390 | 6/1952 | Hague | 60/39.65 |
| 3,158,114 | 11/1964 | Nikodem | 98/62 |
| 3,477,358 | 11/1969 | Howard | 98/64 |
| 3,899,882 | 8/1975 | Parker | 60/39.65 |

FOREIGN PATENT DOCUMENTS

| | | | |
|---|---|---|---|
| 1260872 | 2/1968 | Fed. Rep. of Germany | 60/39.65 |
| 560241 | 3/1944 | United Kingdom | 98/64 |

*Primary Examiner*—Louis J. Casaregola
*Attorney, Agent, or Firm*—F. A. Winans

[57] ABSTRACT

A covered air scoop for a gas turbine combustor comprising a tubular member radially extending through the combustor shell to define an air inlet. A symmetrical cap member is disposed in spaced, overhanging relationship over the inlet. To enter the combustor, the air must flow into the cap member, thereby causing all air to enter the tube in a substantially uniform manner so that the air flow through all similarly constructed air tubes at a common axial location of the combustor is substantially equal at all times.

9 Claims, 4 Drawing Figures

GAS TURBINE COMBUSTOR AIR INLET

BACKGROUND OF THE INVENTION

1. Field of the Invention

This invention relates to a combustor for a gas turbine engine, and more particularly to air scoops for such a combustor having a symmetrical cover to eliminate variations in air flow therethrough caused by the random motion of the air on the outside of the combustor shell.

2. Description of the Prior Art

In gas turbine engines, the combustion chamber (combustor) is generally enclosed in a casing into which compressed air is delivered. The compressed air enters the combustor through openings in the sidewall thereof for primary combustion air, film cooling, dilution and temperature profiling of the exiting combustion gases. However, as the air in the casing is continuously moving in a random manner, its entry into the combustor through any of the various openings is not uniform, but continuously varies for any one such opening and also varies as between similarly sized and positioned openings.

Thus, for the most part, openings into the combustor, at least in cylindrical combustors of the type used in gas turbines of the assignee of the present invention, are placed in annular arrays at certain axial locations thereon to maintain, as closely as possible, symmetry of the combustion process, temperature profiling, wall cooling, etc. within the combustor. However, because of the above random direction and velocity of the air movement around the exterior of the combustor, such symmetry is difficult to obtain.

In the combustion process, it is desirable to have predictability of the air entry in that a certain amount of penetration of the air into the axially entering atomized fuel is necessary for complete combustion of the fuel. Thus, if at times the air flow exteriorly of the combustor has primarily an axial or circumferential flow while at other times or at other combustor air inlets at the same time the flow is primarily radially into the combustor, it is obvious that air penetration is effected, which in turn effects the combustion process, i.e., producing unburned fuel resulting in smoke and high emissions, and producing areas of elevated combustion temperatures adjacent certain areas of the combustor walls and thereby producing thermal stresses in the combustor. Other deleterious effects such as unpredictable startup, nonuniform temperature distribution, etc. also result from such random entry of the air into the combustion zone.

U.S. Pat. Nos. 3,581,492 and 2,916,878 are examples of structure directed to obtain some uniformity to the combustion air entering a combustor. However, it is noted that these structures are not symmetrical and are, for the most part, turning vanes or scoops facing upstream on the assumption the air on the outside of the combustor is flowing axially downstream into the structure. Since the exterior air actually has a swirling random motion, such structure may reduce the nonuniformity problem somewhat, but would not eliminate it.

SUMMARY OF THE INVENTION

The present invention comprises tubular combustion air entry scoops extending radially through the combustor wall, having an internal extending portion for penetration of the air entering the combustion zone, and an external extending portion for mounting over the inlet end in spaced relation to the inlet of the tube and the wall of the combustor, a symmetrical overhanging cap member. The cap member requires that all air entering the tube flows in a definite pattern regardless of the direction of flow of the exterior air prior to entering the tube, thereby establishing the uniform flow (assuming a uniform pressure drop between the external compressed air and the interior of the combustor) at all times and at all such air entry scoops at a common axial position. Thus, uniformity of the combustion conditions can be established along with predictable ignition and uniform temperature distribution.

DESCRIPTION OF THE PREFERRED EMBODIMENT

Reference is initially made to U.S. Pat. No. 3,899,882 having a common assignee as the present invention and which illustrates a gas turbine having a generally cylindrical combustor with annular arrays of air inlets from the chamber surrounding the combustor into various axial locations along the axis of the combustor. Those inlets (hereinafter called scoops) designated 50 therein which direct air into the primary combustion zone of the combustor typify the location of the air inlet tubes or scoops of the present invention. For this showing, the above-identified patent is herein incorporated by reference.

Figure 1:
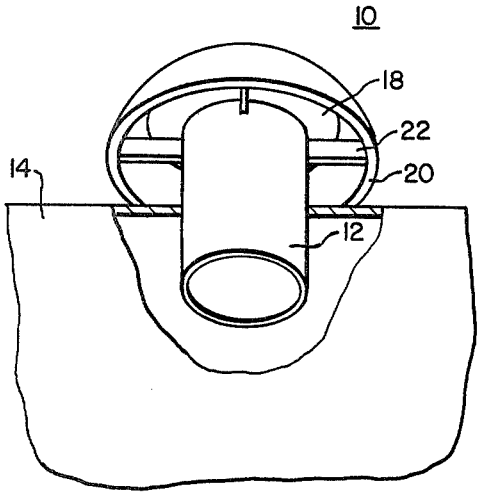
FIG. 1 is an isometric view of an air entry tube of the present invention.

The scoops 10 of the present invention as shown in FIG. 1 herein comprise a hollow tubular member 12 open at both ends and extending generally radially through the wall 14 of a combustor. (It should be noted that, in practice, six to eight of such scoops would be disposed equi-angularly about the combustor at a common axial location to direct the air into the combustion zone.) The tubular member 12 projects both inwardly from the wall 14 a sufficient distance to provide the desired air penetration into the combustion zone and outwardly so that the open inlet end 16 of the tube is a sufficient distance from the wall 14 of the combustor to be able to support an overhanging cap member 18 (to be described) without restricting the air access to the inlet between the cap member and the combustor wall.

Figure 2:
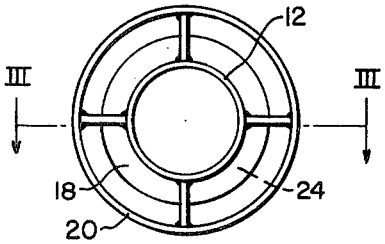
FIG. 2 is a plan view looking into the discharge end of the tube.

The cap member 18, which is symmetrical about the axis of the tube 12, is supported on the tube in spaced relation thereto with an overhanging relationship such that the peripheral portion 20 of the cap is radially closer to the combustor wall 14 than the inlet 16 of the tube. In the embodiment shown in FIGS. 1, 2 and 3, the cap member 18 is seen to be semi-spherical to form a generally mushroom-shaped silhouette.

The inner diameter of the peripheral portion 20 is substantially larger than the outer diameter of the tube 12 and the spacing between the inner top of the cap and the tube also is sufficient so that in neither area is the flow restricted.

The cap 18 is secured to the tube 12 through spokes or webs 22 extending therebetween and joining the common overhanging portion to the top of the tube (four such spokes being shown). In that the parts are fabricated from metal, they can be secured together as by welding.

Figure 3:
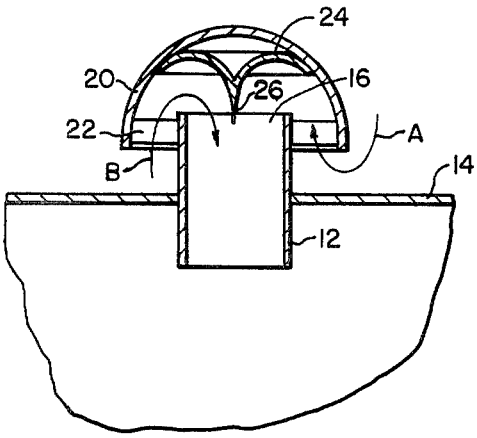
FIG. 3 is an elevational cross sectional view along lines III—III of FIG. 2.

Thus, with this cap member 18 covering the inlet 16 to the tube 12, in a spaced overhanging relationship, all air entering the tube 12 must do so via a common route, typified by the arrow A of FIG. 3. This then prevents variations in flow volume and velocity previously produced by the swirling air entering the scoops from continuously varying routes and having various velocity vectors that effected the final entry of the air into the combustion zone.

It is inherent in the above structure, by virtue of the overhanging cap member causing the flowing air to take a somewhat circuitous path, that losses (i.e., increased pressure drop) occur which affect to some degree the efficiency of the gas turbine engine. To minimize such losses, a turning vane 24 is positioned within the cap to define a continuously smooth surface for directing the air flow through the cap 18 and into the tube inlet 16. The turning vane 24 comprises an inverted cone having a concavely rounded wall, welded to the internal upper portion of the cap with the inwardly pointing apex 26 of the cone in alignment with the axis of the tube 12. Thus, the flow path through the cap is essentially as shown by the arrow B in FIG. 3.

Figure 4:
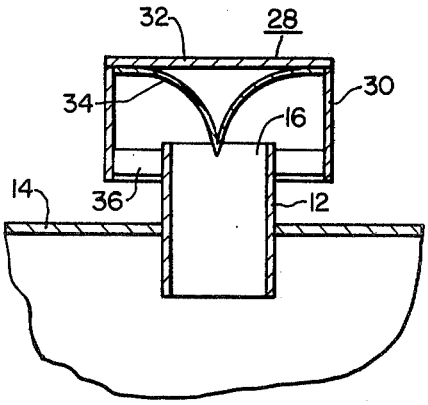
FIG. 4 is a view similar to FIG. 3 of another form of the air entry tube according to the present invention.

Referring now to FIG. 4, another embodiment of the invention is shown. However, as opposed to a semi-spherical cap portion as above, the cap member 28 of this embodiment is generally cylindrical, and thus easier to fabricate. Thus, the cap 28 has cylindrical side walls 30 terminating radially inwardly in overhanging relationship to the tube inlet 16. A top plate 32 encloses the walls and is spaced from the inlet 16 a distance sufficient to prevent any flow restriction therebetween as is the space between the side wall 30 and the tube 12. A guide vane 34 is attached to the internal surface of the cap to provide a streamline surface for the flowing air and the cap 28 is secured by spokes 36 joining the side walls 30 to the tube 12 as before.

Thus, in both embodiments, and obvious variations thereon, all air entering the tube inlet 16 does so from the common symmetrical flow path that eliminates non-uniformity of the flow into the combustor and thereby permits predictable and designed combustion performance to occur therein.

I claim:

1. In a combustion chamber for a gas turbine engine wherein said chamber comprises an axially extending shell member generally closed at the upstream end and having an array of openings through said shell at a predetermined axial location along said member for admitting air into said chamber, a generally radially extending tube member disposed within each of said openings to impart an inward direction to said air for penetration thereof into said chamber, said tube members extending both inwardly and outwardly of said shell to define an exterior air inlet and interior air outlet and wherein the improvement comprises:

a symmetrical cap member disposed to enclose said inlet in a spaced relation, with the innermost terminal periphery of said cap member radially inwardly of said inlet and having an inner diameter greater than the outer diameter of said tube member;

whereby all air entering said tube members must first flow generally outwardly into the space between said cap member and said inlet prior to entering said tube member, thereby providing a generally uniform flow into any one of said tube members irrespective of the generally random air flow exteriorly of said shell and also providing substantially equal flow through all of said tube members at said predetermined axial location on said shell.

2. Structure according to claim 1 wherein said cap member includes an interior surface defining a symmetrical turning vane for directing air flow into said inlet.

3. Structure according to claim 1 including means for mounting said cap member to said tube member comprising a plurality of spoke-like members extending therebetween.

4. Structure according to claim 3 wherein said spatial relationship between said cap member and said inlet is sufficient to accommodate the volumetric flow through the tube member without restriction.

5. Structure according to claim 4 wherein the peripheral edge of said cap member is disposed outwardly from the surface of said shell a distance sufficient to provide volumetric flow through said tube member without restriction.

6. In combination with a tubular combustion-air scoop for a combustion chamber, said scoop having an air inlet end and an air outlet end, means overlying said air inlet end in spaced relation thereto, and having an axially overhanging portion with respect to said tube at said inlet end defining therebetween a symmetrical air flow path causing all air entering said inlet end to have a common direction at its entry to provide uniform flow thereinto regardless of the random air flow exteriorly thereof.

7. Structure according to claim 6 wherein said means comprises a symmetrical cap member having an interior surface defining a symmetrical turning vane for directing air flow into said inlet.

8. Structure according to claim 7 including means for mounting said cap member to said tubular scoop adjacent the inlet end, said means comprising a plurality of spoke members extending therebetween.

9. Structure according to claim 8 wherein said spaced relationship permits sufficient volumetric flow so that air flow through said tube is substantially unrestricted thereby.

* * * * *